US007014441B2

(12) United States Patent
Haynes et al.

(10) Patent No.: US 7,014,441 B2
(45) Date of Patent: Mar. 21, 2006

(54) FIBER DRAW UNIT NOZZLES FOR USE IN POLYMER FIBER PRODUCTION

(75) Inventors: Bryan David Haynes, Cumming, GA (US); Douglas J. Hulslander, Woodstock, GA (US); Michael Charles Cook, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 259 days.

(21) Appl. No.: 10/286,425

(22) Filed: Nov. 1, 2002

(65) Prior Publication Data

US 2004/0086588 A1 May 6, 2004

(51) Int. Cl.
*D01D 5/092* (2006.01)

(52) U.S. Cl. ..... 425/66; 425/72.2

(58) Field of Classification Search ..... 425/66, 425/72.2, 378.2, 382.2; 156/433, 441
See application file for complete search history.

(56) References Cited

U.S. PATENT DOCUMENTS

| | | | | |
|---|---|---|---|---|
| 2,379,824 A | * | 7/1945 | Mummery | 34/380 |
| 3,352,653 A | * | 11/1967 | Speth | 65/525 |
| 3,929,542 A | | 12/1975 | Gehrig et al. | 156/167 |
| 4,322,027 A | * | 3/1982 | Reba | 226/97.4 |
| 4,340,563 A | | 7/1982 | Appel et al. | 264/518 |
| 4,405,297 A | | 9/1983 | Appel et al. | 425/72.2 |
| 4,701,294 A | | 10/1987 | Radwanski et al. | 264/518 |
| 4,908,163 A | | 3/1990 | McAmish et al. | 264/12 |
| 5,292,239 A | * | 3/1994 | Zeldin et al. | 425/66 |
| 5,397,413 A | | 3/1995 | Trimble et al. | 156/167 |
| 5,435,708 A | | 7/1995 | Kaun | 425/72.2 |
| 5,460,500 A | | 10/1995 | Geus et al. | 425/66 |
| 5,580,581 A | * | 12/1996 | Buehning | 425/7 |
| 5,695,377 A | | 12/1997 | Triebes et al. | 442/359 |
| 5,762,857 A | | 6/1998 | Weng et al. | 246/469 |
| 5,814,349 A | | 9/1998 | Geus et al. | 430/567 |
| 5,820,888 A | | 10/1998 | Geus et al. | 425/66 |
| 5,935,512 A | | 8/1999 | Haynes et al. | 264/553 |
| 6,019,152 A | | 2/2000 | Haynes et al. | 156/433 |
| 6,174,474 B1 | | 1/2001 | Stein et al. | 264/129 |
| 6,379,136 B1 | | 4/2002 | Najour et al. | 425/66 |

FOREIGN PATENT DOCUMENTS

| | | |
|---|---|---|
| EP | 635 077 | 1/1995 |
| WO | 93/21370 | 10/1993 |
| WO | WO 93/24693 | 12/1993 |

* cited by examiner

*Primary Examiner*—Joseph S. Del Sole
(74) *Attorney, Agent, or Firm*—Pauley Petersen & Erickson

(57) ABSTRACT

A nozzle is described for downwardly directing air from an air intake of a fiber draw unit into a longitudinal channel of the fiber draw unit for forming spunbond polymeric fibers. The nozzle includes an upper eductor connected to the fiber draw unit and a lower eductor adjustably connected to the fiber draw unit and below the upper eductor. The nozzle includes a nozzle cavity that narrows from a nozzle inlet to a nozzle outlet and includes a downward turn of 90 degrees or less. Air directed through the nozzle outlet flows in a direction parallel to a wall of the longitudinal channel.

20 Claims, 3 Drawing Sheets

FIBER DRAW UNIT NOZZLES FOR USE IN POLYMER FIBER PRODUCTION

FIELD OF INVENTION

The present invention relates to nozzles for use in fiber draw units for producing fibers using spunbonding techniques.

BACKGROUND OF THE INVENTION

The production of man-made fibers has long used spunbonding techniques to produce fibers for use in forming nonwoven webs of a material. FIGS. 1A and 1B illustrate prior art machines which manufacture nonwoven webs using spunbonding techniques.

FIG. 1A illustrates a prior art apparatus 10 for producing spunbond fibers. The spunbond apparatus typically contains a fiber draw unit 12 positioned above an endless belt 20 which is supported on rollers 22. FIG. 1B illustrates general schematics of the inside portions of fiber draw unit 12 taken along lines 1B in FIG. 1A. Fiber draw unit 12 includes a longitudinal air chamber which contains an upper portion 14, a mid-portion 16, and a lower portion or tail pipe 18. The fiber draw unit also includes a first air plenum 30 and an air nozzle represented by reference numeral 32 leading from the first air plenum 30 to mid-portion 16 of the fiber draw unit 12. Additionally, a second air plenum 34 also communicates with mid-portion 16 of the fiber draw unit 12 via an additional air nozzle represented by reference numeral 36. The spunbond apparatus 10 also includes equipment 38 known in the art for melting and extruding polymer resin through dies to create fibers 40. Typically, this equipment feeds resin fed from a supply to a hopper extruder, through a filter, and finally through a die to create the fibers 40. The fibers are quenched by cool air entering the fiber draw unit 12 through upper air quench ducts 46 and 48.

High velocity air is admitted into the fiber draw unit 12 through plenums 30 and 34 via air inlets 42 and 44, respectively. The addition of air to the fiber draw unit 12 through nozzles 32 and 36 aspirates air from above the fiber draw unit through upper air quench ducts 46 and 48. The air and fibers then exit through tail pipe 18 into exit area 50. Generally, air admitted into the fiber draw unit 12 draws fibers 40 as they pass through the fiber draw unit. The drawn fibers are then laid down on endless belt 20 to form a non-woven web 52 as is seen in FIG. 1A. Rollers 54 may then remove the non-woven web from the endless belt 20 and further press the entangled fibers together to assist in forming the web. The web 52 is then typically bonded to form the finished material. Spunbond nonwoven fabrics are generally bonded in some manner as they are produced in order to give them sufficient structural integrity to withstand the rigors of further processing into a finished product. Bonding can be accomplished in a number of ways such as hydroentanglement, embossing by calender and anvil, needling, ultrasonic bonding, adhesive bonding, stitchbonding, through-air bonding, and thermal bonding.

It is an object of the present invention to provide novel air nozzles for directing air into a fiber draw unit. It is a further object of this invention to provide novel nozzle geometries that provide improved, desirable air flow into the fiber draw unit, which in turn affects the characteristics of the drawn fibers.

It is a further object of the present invention to provide a novel adjustable nozzle that allows varying the size of a nozzle outlet. It is yet another object of this invention to provide an adjustable nozzle having less deflection due to air pressure through the nozzle.

SUMMARY OF THE INVENTION

The present invention relates to nozzles for use in fiber draw units for forming spunbond fibers. In one embodiment of this invention the nozzle downwardly directs air from an air intake of a fiber draw unit into a longitudinal channel of the fiber draw unit for drawing, or extending, polymeric fibers. The nozzle includes an upper eductor connected to the fiber draw unit and a lower eductor adjustably connected to the fiber draw unit located below the upper eductor.

The nozzle of this invention includes a nozzle cavity formed between the upper eductor and the lower eductor having a nozzle outlet at a first end connecting the nozzle cavity and the longitudinal channel of the fiber draw unit. The nozzle outlet includes a gap having a diameter that can be altered by adjusting the lower eductor. A nozzle inlet is located at a second end of the nozzle cavity opposite the nozzle outlet.

In another embodiment of this invention, a nozzle for downwardly directing air from an air intake of a fiber draw unit into a longitudinal channel of the fiber draw unit for forming polymeric fibers includes an upper eductor connected to the fiber draw unit and a lower eductor adjustably connected to the fiber draw unit below the upper eductor. A nozzle cavity between the upper eductor and the lower eductor includes a nozzle outlet at a first end of the nozzle cavity, connecting the nozzle cavity and the longitudinal channel of the fiber draw unit, and a nozzle inlet at a second end of the nozzle cavity opposite the first end. The nozzle cavity narrows from the nozzle inlet to the nozzle outlet and includes a downward turn of 90 degrees or less. In one embodiment of this invention, air is directed through the nozzle outlet at an angle of about 0° to 30° from a channel wall of the longitudinal channel.

The nozzles of this invention include improved designs and geometries that provide improved and desirable air flow characteristics. In one embodiment of this invention, a nozzle for directing air from an air intake of a fiber draw unit into a longitudinal channel of the fiber draw unit includes an upper eductor connected to the fiber draw unit, a lower eductor connected to the fiber draw unit beneath the upper eductor, and a nozzle cavity between the upper eductor and lower eductor. The nozzle cavity includes a nozzle outlet connecting the nozzle cavity and the longitudinal channel of the fiber draw unit and a nozzle inlet on an opposite end of the nozzle cavity in combination with an air inlet of the fiber draw unit. The nozzle cavity has a length to diameter ratio of less than about 10 and a convergence angle of at least about 10°. The ratio of the nozzle inlet area to the nozzle outlet area is desirably at least about 20 and the nozzle has a nozzle injection angle of about 0° to 30°.

BRIEF DESCRIPTION OF THE DRAWINGS

These and other objects and features of this invention will be better understood from the following detailed description taken in conjunction with the drawings, wherein.

DESCRIPTION OF PREFERRED EMBODIMENTS DEFINITIONS

As used herein the term "nonwoven" or "nonwoven fabric or web" means a web having a structure of individual fibers or threads which are interlaid, but not in an identifiable manner as in a knitted fabric. Nonwoven fabrics or webs can be formed from spunbonding processes using the nozzles for a fiber drawing apparatus disclosed herein.

As used herein the term "spunbond fibers" refers to small diameter fibers which are formed by extruding molten thermoplastic polymer material as filaments from a plurality of fine, usually circular capillaries of a spinneret with the diameter of the extruded filaments then being rapidly reduced by entering into a flowing stream of air. Spunbond fibers are generally not tacky when they are deposited onto a collecting surface. Spunbond fibers are generally continuous and have average diameters (from a sample of at least 10) larger than 7 microns ($\mu$m), more particularly, between about 10 and 20 microns ($\mu$m). Many polyolefins are available for fiber production, for example polyethylenes such as Dow Chemical's ASPUN® 6811A linear low density polyethylene, 2553 LLDPE and 25355 and 12350 high density polyethylene are such suitable polymers. The polyethylenes have melt flow rates, respectively, of about 26, 40, 25, and 12. Fiber forming polypropylenes include Exxon Mobil Chemical Company's ESCORENE® PD 3445 polypropylene and PF-304, available from Montell U.S.A., Inc. Many other commercially available polyolefins are available for creating spunbond fibers using the nozzles and fiber draw units of this invention.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The nozzles of this invention are useful with spunbonding techniques for forming polymer fibers and nonwoven webs. The nozzles are used in combination with a fiber draw unit and a fiber extruder, such as generally described above. The nozzles are typically integrated with the fiber draw unit, and direct air from an air inlet of the fiber draw unit into a longitudinal channel of the fiber draw unit. A thermoplastic polymer material is melt-extruded through a die and extends downward through the longitudinal channel to a collection means, such as an endless belt, beneath the longitudinal channel. The nozzles introduce a pressurized, downwardly directed air flow into the longitudinal channel. The air flow draws the fibers and produces a desired filament diameter.

Figure 1A:
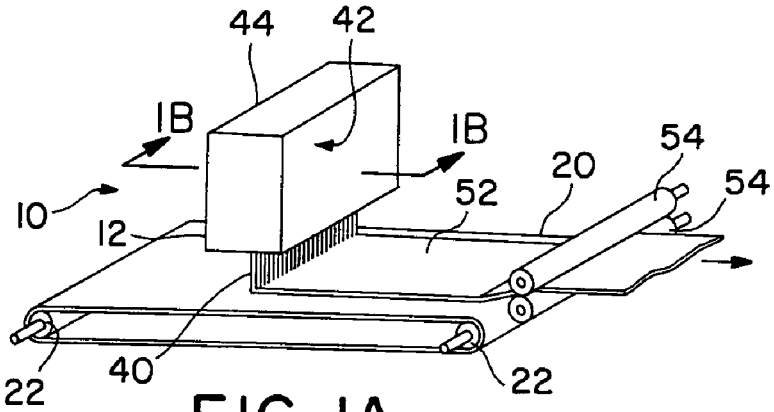
FIG. 1A PRIOR ART
FIG. 1A shows a simplified representation of a prior art apparatus for producing spunbond fibers.
Figure 1B:
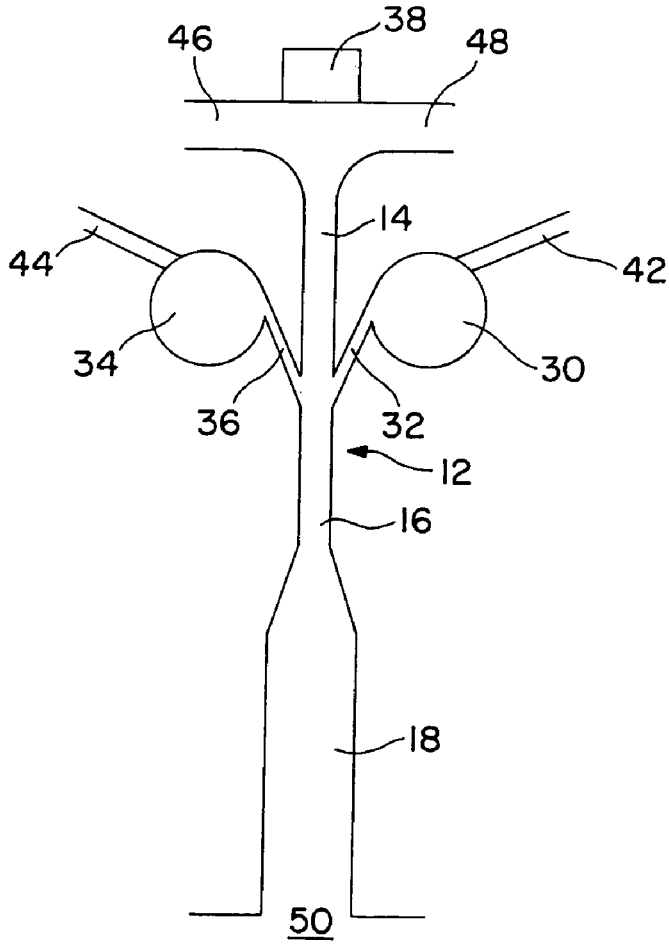
FIG. 1B PRIOR ART
FIG. 1B shows a general cross-sectional view of a typical known fiber draw unit taken along lines 1B.
Figure 2:
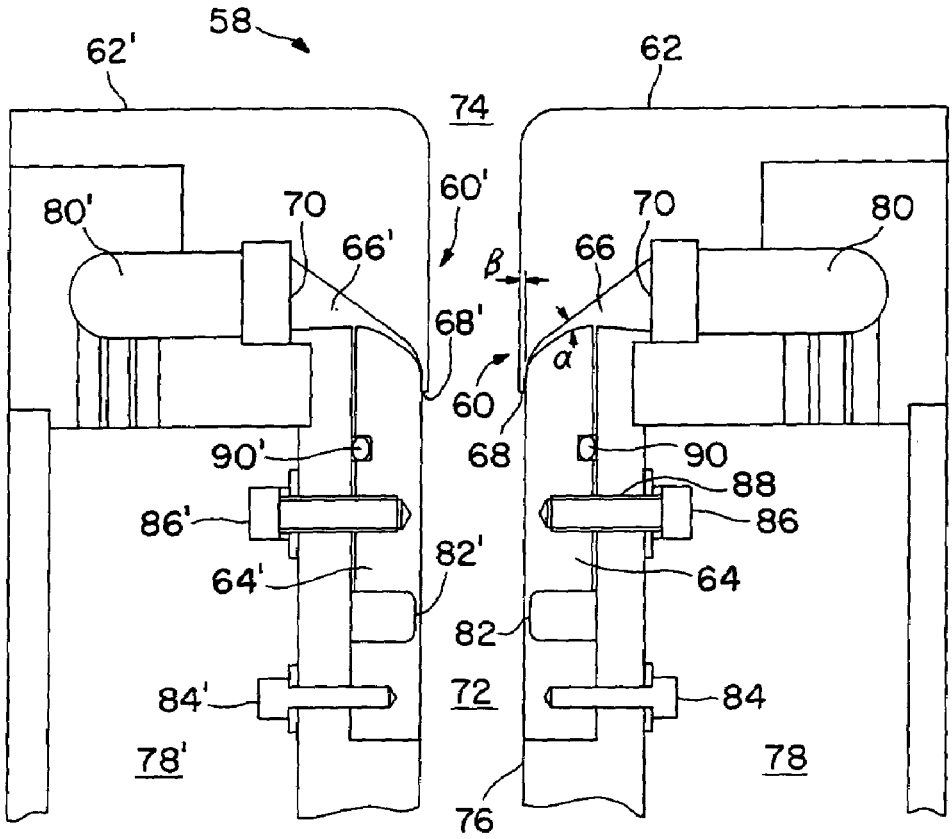
FIG. 2 shows a cross-sectional view of a two nozzles according to one embodiment of this invention in combination with a partially shown fiber draw unit.

FIG. 2 shows a partial view of a fiber draw unit 58 including two nozzles 60 and 60'. In one embodiment of this invention, as shown in FIG. 2A, the nozzles 60 and 60' are located on opposite sides of a longitudinal channel 72 from each other. The nozzles 60 and 60' as shown in FIG. 2 include similar components, which are described below referring to nozzle 60. The nozzle 60 includes an upper eductor 62 connected to the fiber draw unit 58. A lower eductor 64 is connected, and desirably adjustably connected, to the fiber draw unit 58 below the upper eductor 62. A nozzle cavity 66 is formed between the upper eductor 62 and the lower eductor 64. The nozzle cavity 66 includes a nozzle outlet 68 at a first end of the nozzle cavity 66. The nozzle outlet 68 connects the nozzle cavity 66 to a longitudinal channel 72 of the fiber draw unit 58. The nozzle cavity 66 also includes a nozzle inlet 70 at a second end of the nozzle cavity 66 opposite the nozzle outlet 68. The nozzle inlet 70 is at a point of maximum convergence angle, as described below, and is where the nozzle convergence begins. As shown in FIG. 2, the nozzle inlet 70 begins at the air outlet end of a honeycomb 80.

In FIG. 2, the upper eductor 62 of nozzle 60 is located opposite of, and in line with, the upper eductor 62' of the nozzle 60' at fiber entrance 74. A polymer material is melted using appropriate equipment known in the art, and polymer fibers are extruded through a die and enter the longitudinal channel 72 at fiber entrance 74. The longitudinal channel 72 is defined at least in part by a channel wall 76. As shown in FIG. 2, the upper eductor 62 and the lower eductor 64 are integrated with the fiber draw unit 58 and form a portion of the channel wall 76. As the extruded fibers extend through the longitudinal channel 72, pressurized air flows through the nozzle outlet 68 into the longitudinal channel 72 in a downward direction towards a collecting apparatus (not shown). "Downward" or "downwardly" refers to a direction away from the fiber entrance 74 and towards the collecting apparatus at an opposite end of the longitudinal channel 72 from the fiber entrance 74. The downwardly flowing air draws, or extends, the fibers as they move through the longitudinal channel 72 from the fiber entrance 74 to the collecting apparatus. Air enters the fiber draw unit 58 through at least one air inlet (not shown) into a mixing chamber 78. The fiber draw unit can include, in combination with nozzle 60, one mixing chamber 78 or more than one mixing chamber 78 connected via at least one air passageway. Mixing the air in the mixing chambers 78 provides improved air distribution, which in turn improves air velocity uniformity exiting nozzle outlet 68.

The path of air flow through the fiber draw unit 58 and the nozzle 60 begins as air enters through the air inlet into the mixing chamber 78. The air then exits the mixing chamber 78 and enters the nozzle cavity 66 through the nozzle inlet 70. The air exits the nozzle cavity 66 and enters the longitudinal channel 72 through the nozzle outlet 68. As shown in FIG. 2, the air can flow through an optional honeycomb 80 between the mixing chamber 78 and the nozzle inlet 70. The honeycomb 80 includes a collection of small capillary-like air passages, and thus has a cross-section that resembles a honeycomb. The air flow entering the honeycomb 80 is divided into the individual capillary passageways, resulting in a more laminar, less turbulent flow. One skilled in the art reading this description will appreciate that the honeycomb 80 can include various configurations and is optional, and therefore can be substituted with another turbulence-decreasing means or an open area.

In one embodiment of this invention, the lower eductor 64 is adjustably connected to the fiber draw unit 58 below the upper eductor 62. "Adjustably connected" refers to a connection of the lower eductor 64 to the fiber draw unit 58 that allows movement of lower eductor 64 to alter the gap of the nozzle outlet 68. In other words, the size (diameter) of the nozzle outlet 68 of the nozzle cavity 66 can be altered by adjusting the lower eductor 64. The lower eductor 64 includes a bendable portion 82, at which location the lower eductor 64 can bend to narrow or widen the nozzle outlet 68. As seen in FIG. 2, a first bolt 84 attaches the lower eductor 64 to the below the bendable portion 82. A second bolt 86 through the fiber draw unit 58 contacts the lower eductor 64 above the bendable portion 82. In one embodiment of this invention, the second bolt 86 is threaded and passes through a threaded section 88 of the fiber draw unit 58. The second bolt 86 extends into the adjustable lower eductor 64, which is not threaded, until the end of the second bolt touches the lower eductor 64. Tightening the second bolt 86 thus pushes the lower eductor 64 above the bendable portion 82. The lower eductor element 64 bends into the longitudinal channel 72 at bendable portion 82 under the force of the second bolt 86, resulting in the narrowing of the nozzle outlet 68. Oppositely, by loosening the second bolt 86, the lower eductor 64 returns to its original position causing a widening of the nozzle outlet 68. A sealing member 90, such as a rubber "o"-ring, can be included to eliminate air flow from the air mixing chamber 78 and the nozzle cavity 66 between the lower eductor 64 and the fiber draw unit 58. A notch in the lower eductor 64 can be used to hold the sealing member 90 in place.

Figure 3:
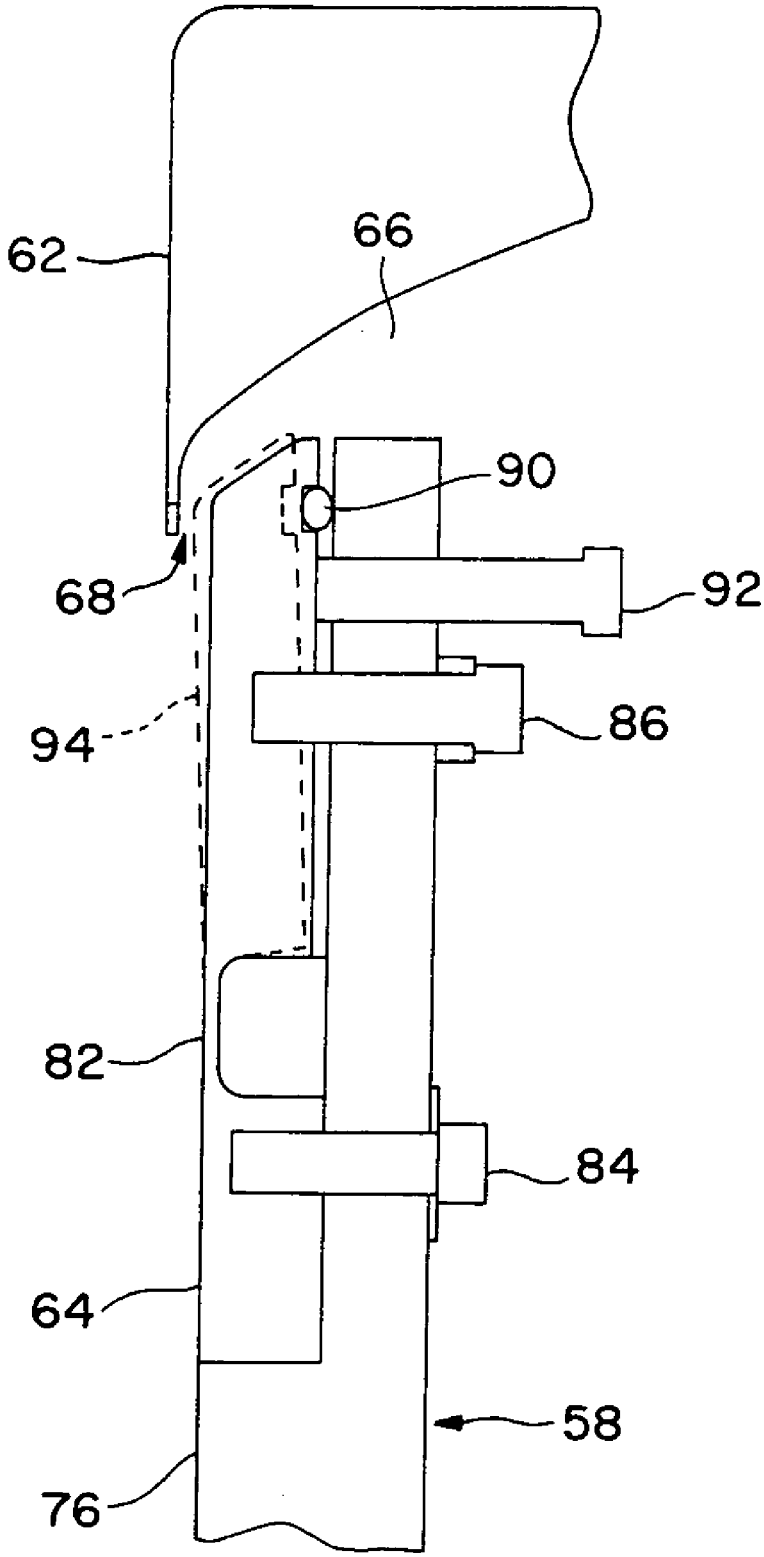
FIG. 3 shows a cross-sectional view of a nozzle according to one embodiment of this invention.

In another embodiment of this invention, as shown in FIG. 3, three bolts are used to adjustably connect the lower eductor 64 to the fiber draw unit 58. The first bolt 84 fixedly connects the lower eductor 64 to the fiber draw unit 58 below the bendable portion 82. The second bolt 86 inserted above the bendable portion 82 can be a "pull" bolt that pulls the lower eductor 64 towards the fiber draw unit, thereby widening the nozzle outlet 68. The second bolt 86 is not threaded in a region passing through the wall of the fiber draw unit 58, and is threaded at a region entering the lower eductor 64, which includes coordinating threads to receive the second bolt 86. A third bolt 92 can be a "push" bolt that when tightened, pushes on the lower eductor 64 and forces the lower eductor 64 to bend into the longitudinal channel 72 at bendable portion 82, thereby narrowing the nozzle outlet 68. The third bolt 92 is threaded and works in combination with a threaded hole through the wall of fiber draw unit 58. The third bolt 92 pushes on a side of the lower eductor 64. Outline 94 shows a position of the lower eductor 64 upon bending at bendable portion 82 and narrowing the nozzle outlet 68. In one embodiment of this invention, more than one second bolt 86 and more than one third bolt 92 are staggered and/or alternating positioned along a horizontal length of the fiber draw unit, meaning that the second bolt 86 and the third bolt 92 are not aligned directly above and below each other in a vertical plane but lateral to each other along the horizontal length of the fiber draw unit 58. The alternating positions of the second bolts 86 and the third bolts 92 allow for adjustments to the nozzle outlet 68 along the horizontal length of the nozzle outlet 68. In one embodiment of this invention the width of the nozzle outlet is adjustable between the upper eductor and the lower eductor from about 0.01 to 0.05 inches (0.0254 to 0.127 centimeters) wide, more suitably about 0.02 to 0.04 inches (0.0508 to 0.1016 centimeters).

Prior art nozzles typically adjust the nozzle size through an adjustable upper eductor. The adjustably connected lower eductor 64 provides an advantage over the prior art in that the upper eductor 62 can be fixedly connected to the fiber draw unit 58, thereby providing increased rigidity as the air pressure through the nozzle cavity 66 pushes on the upper eductor 62. With an adjustable upper eductor, as known in the art, the air pressure deflects the upper eductor into the fiber draw unit channel. Deflection of the upper eductor is undesirable as the dimensions of the nozzle cavity and nozzle outlet will change. The upper eductor 62 of this invention is fixedly attached to the fiber draw unit 58, and deflection is reduced due to a more secure connection. In addition, the upper eductor 62 is larger than typical currently known upper eductors. The larger size also reduces upper eductor deflection. In one embodiment of this invention, the upper eductor 62 has less than about 0.001 inch (0.00254 centimeter) deflection at an air pressure of about 10 pounds per square inch.

The characteristics of the air flow exiting the nozzle outlet can affect the stability of the spunbond fibers. The nozzle size and design affect the air flow characteristics leaving the nozzle. The nozzles of this invention include configurations that provide an improved air flow leaving the nozzle outlet 68, and therefore provide improved fibers. Nozzle geometries including the length to diameter ratio, the nozzle convergence, the nozzle contraction ratio, and the nozzle injection angle are important factors influencing the air flow leaving the nozzle outlet 68.

It is desirable that to maintain a boundary layer property of the air flow as it leaves the nozzle outlet 68. "Boundary layer" refers to a thin shear layer or velocity profile of air flow near the channel wall 76. The length to diameter ratio of the nozzle cavity 66 can influence the boundary layer properties of an air flow. The length to diameter ratio is obtained by dividing the length of the nozzle cavity 66 as measured between the nozzle inlet 70 and the nozzle outlet 68 by the average diameter of the nozzle cavity 66 between the nozzle inlet 70 and the nozzle outlet 68. The "diameter" of each of the nozzle cavity 66, the nozzle outlet 68, and the nozzle inlet 70 refers to the distance of each of the nozzle cavity 66, the nozzle outlet 68, and the nozzle inlet 70 measured between the upper eductor 62 and the lower eductor 64. The air flow produced by the nozzles of this invention is generally considered fully developed, referring to shear being present throughout the flow field, at length to diameter vales of greater than about 50. As the length to diameter ratio increases, there is typically a higher level of turbulence within the air flow because the turbulence is shear driven. Therefore it is advantageous to reduce the length to diameter ratio providing a constant velocity through the nozzle cavity 66. In one embodiment of this invention, the nozzle cavity includes a length to diameter ratio of about 3 to 10, more suitably about 4 to 8, and desirably about 4.5.

As seen in FIG. 2 the nozzle cavity 66 narrows between the nozzle inlet 70 and the nozzle outlet 68. The convergence angle of the nozzle cavity 66 can also affect the air flow characteristics. "Convergence angle" or "convergence" refers to the relative angle of reduction between the opposing surfaces of the nozzle cavity 66. Convergence angle is represented in FIG. 2 by angle $\alpha$. Increasing the convergence angle of the nozzle cavity can improve the boundary layer characteristics of the air flow by flattening the profile of the air flow. The relationship of convergence and air flow properties, particularly boundary layer character, is further described in *Boundary Layer Theory*, Seventh Edition, Schlichting and Hermann, McGraw Hill, pages 108–109, herein incorporated by reference. In one embodiment of this invention the nozzle cavity 66 has a convergence of at least 10°, and more suitably about 12° to 36°. The convergence angle can incur a slight change by adjusting the lower eductor 64.

As discussed above, the nozzle cavity 66 of this invention narrows or contracts between the nozzle inlet 70 and the nozzle outlet 68. A contraction ratio of the nozzle cavity 66 is the ratio of the area of the nozzle inlet 70 to the area of the nozzle outlet 68. The contraction ratio is controlled by both the length to diameter ratio and the convergence angle.

In one embodiment of this invention, the contraction ratio of the nozzle inlet area to the nozzle outlet area is at least about 20, more suitably about 30, and desirably about 30 to 50.

Figure 4:
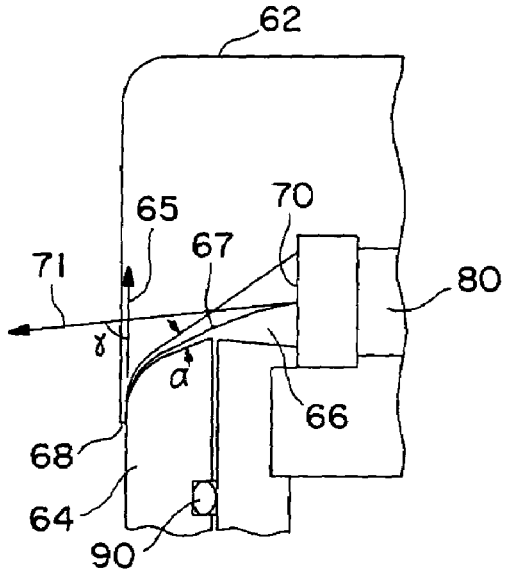
FIG. 4 shows a partial, enlarged cross-sectional view of one of the nozzles of FIG. 2.

The angle at which the air flow enters the longitudinal channel 72 from the nozzle outlet 68 also plays a role in defining the air flow characteristics. In one embodiment of this invention, a nozzle for downwardly directing air from an air intake of a fiber draw unit into a longitudinal channel of the fiber draw unit for forming polymeric fibers includes an upper eductor 62 connected to the fiber draw unit 58 and a lower eductor 64 adjustably connected to the fiber draw unit 58 and below the upper eductor 62. A nozzle cavity 66 between the upper eductor 62 and the lower eductor 64 includes a nozzle outlet 68 at a first end of the nozzle cavity connecting the nozzle cavity 66 and the longitudinal channel 72 of the fiber draw unit 58 and a nozzle inlet 70 at a second end of the nozzle cavity 66 opposite the first end and the nozzle outlet 68. The nozzle cavity 66 narrows from the nozzle inlet 70 to the nozzle outlet 68 and includes a downward turn of about 90 degrees or less, suitably about 10 to 80 degrees, and desirably about 45 to 75 degrees. The "downward turn" of the nozzle refers to a change in direction of the nozzle cavity 66 from the nozzle inlet 70 to the nozzle outlet 68 towards the collecting apparatus at an end of the longitudinal channel 72 opposite the fiber entrance 74. As shown in FIG. 4, the angle of the downward turn is the angle of intersection, shown as angle $\gamma$, between a tangent 71 of a nozzle cavity centerline 67 at the nozzle inlet 70 and a tangent 65 of the nozzle cavity centerline 67 at the nozzle outlet 68. The angle $\gamma$ is measured counterclockwise from the tangent 71 of a nozzle cavity centerline 67 at the nozzle inlet 70 to the tangent 65 of the nozzle cavity centerline 67 at the nozzle outlet 68.

The angle at which the air flow exits the nozzle cavity 66 through the nozzle outlet 68 is the nozzle injection angle. The nozzle injection angle is the angle between a centerline of the nozzle outlet 68 and the channel wall 76 of the longitudinal channel 72, and is shown in FIG. 2 as angle $\beta$. The nozzle injection angle is known in the art to play a role in the stability of the spunbond fibers drawn through the longitudinal channel 72. Decreasing the injection angle typically decreases turbulence, and oppositely, increasing the injection angle typically increases turbulence in the air flow leaving the nozzle outlet 68. The nozzle injection angle can also be used to reduce fouling on the channel wall 76 which provides operational benefits and can result in more uniformly dispersed fibers across the longitudinal channel 72.

In one embodiment of this invention, the air is directed through the nozzle outlet 68 in a direction parallel to the wall 76 of the longitudinal channel 72. In other words the nozzle injection angle $\beta$ is 0°. In another embodiment of this invention, the air is directed through the nozzle outlet 68 at an angle $\beta$ of about 0° to 30° from the wall 76 of the longitudinal channel 72.

Various combinations of the above described nozzle design geometries are available for the nozzles of this invention. In one embodiment of this invention, a nozzle 60 for directing air from an air intake of a fiber draw unit 58 into a longitudinal channel 72 of the fiber draw unit 58 includes an upper eductor 62 connected to the fiber draw unit 58, a lower eductor 68 connected to the fiber draw unit 58 beneath the upper eductor, and a nozzle cavity 66 between the upper eductor 62 and lower eductor 64. The nozzle cavity 66 includes a nozzle outlet 68 connecting the nozzle cavity 66 and the longitudinal channel 72 of the fiber draw unit 58 and a nozzle inlet 70 on an opposite end of the nozzle cavity 66 in combination with an air inlet of the fiber draw unit 58. The nozzle cavity 66 has a length to diameter ratio of about 3 to 10, more suitably about 3 to 5, and a convergence angle of at least about 10°. The nozzle cavity 66 thus narrows from the nozzle inlet 70 to the nozzle outlet 68. The ratio of the nozzle inlet area to the nozzle outlet area is at least about 20 and the nozzle 60 includes a nozzle injection angle of about 0° to 30°.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A nozzle for downwardly directing air from an air intake of a fiber draw unit into a longitudinal channel of the fiber draw unit for forming polymeric fibers, comprising:

an upper eductor connected to the fiber draw unit;

a lower eductor adjustably connected to the fiber draw unit and below the upper eductor, the lower eductor including a bendable portion comprising a reduced thickness; and a nozzle cavity formed between the upper eductor and the lower eductor, the nozzle cavity including a nozzle outlet at a first end and connecting the nozzle cavity and the longitudinal channel of the fiber draw unit, the nozzle outlet of the nozzle cavity having a gap that can be altered by bending the lower eductor at the bendable portion.

2. The nozzle of claim 1, further comprising a nozzle inlet at a second end of the nozzle cavity opposite the nozzle outlet, the nozzle outlet having an outlet diameter and the nozzle inlet having an inlet diameter, wherein a ratio of a nozzle inlet area to a nozzle outlet area is at least about 20.

3. The nozzle of claim 2, wherein the ratio of the nozzle inlet area to the nozzle outlet area is at least about 30.

4. The nozzle of claim 1, wherein the nozzle cavity has a convergence angle of at least about 10°.

5. The nozzle of claim 1, farther comprising a nozzle injection angle of about 0° to 30°.

6. The nozzle of claim 1, farther comprising a sealing member between the lower eductor and the fiber draw unit.

7. The nozzle of claim 1, wherein the upper eductor is fixed to the fiber draw unit and has less than about 0.00254 centimeters deflection into the longitudinal channel at an air pressure of about 10 pounds per square inch in the nozzle cavity.

8. A nozzle for downwardly directing air from an air intake of a fiber draw unit into a longitudinal channel of the fiber draw unit for forming polymeric fibers, comprising:

an upper eductor connected to the fiber draw unit;

a lower eductor adjustably connected to the fiber draw unit and below the upper eductor;

a nozzle cavity between the upper eductor and the lower eductor, the nozzle cavity including a nozzle outlet at a first end of the nozzle cavity connecting the nozzle cavity and the longitudinal channel of the fiber draw unit and a nozzle inlet at a second end of the nozzle cavity opposite the first end;

wherein the nozzle cavity narrows from the nozzle inlet to the nozzle outlet and includes a downward turn of about 90 degrees or less, and air is directed through the nozzle outlet in a direction parallel to a wall of the longitudinal channel.

9. The nozzle of claim 8, wherein the nozzle cavity includes a downward turn of about 10 to 80 degrees.

10. The nozzle of claim 9, wherein the nozzle cavity includes a downward turn of about 45 to 75 degrees.

11. The nozzle of claim 8, wherein the nozzle outlet of the nozzle cavity can be altered by adjusting the lower eductor.

12. The nozzle of claim 8, wherein the nozzle outlet includes an outlet diameter and the nozzle inlet includes an inlet diameter, wherein a ratio of a nozzle inlet area to a nozzle outlet area is at least about 20.

13. The nozzle of claim 12, wherein the ratio of the nozzle inlet area to the nozzle outlet area is at least about 30.

14. The nozzle of claim 8, wherein the nozzle cavity has a convergence angle of at least about 10°.

15. The nozzle of claim 8, wherein air is directed trough the nozzle outlet at an angle of about 0° to 30° from a channel wall of the longitudinal channel.

16. The nozzle of claim 8, further comprising a sealing member between the lower eductor and the fiber draw unit.

17. The nozzle of claim 8, wherein the upper eductor is fixed to the fiber draw unit and has less than about 0.00254 centimeters deflection into the longitudinal channel at an air pressure of about 10 pounds per square inch in the nozzle cavity.

18. A nozzle for directing air from an air intake of a fiber draw unit into a longitudinal channel of the fiber draw unit, comprising:

an upper eductor connected to the fiber draw unit;

a lower eductor connected to the fiber draw unit beneath the upper eductor; and a nozzle cavity between the upper eductor and lower eductor, the nozzle cavity including a nozzle outlet connecting the nozzle cavity and the longitudinal channel of the fiber draw unit and a nozzle inlet on an opposite end of the nozzle cavity in combination with an air inlet of the fiber draw unit, the nozzle cavity narrowing from the nozzle inlet to the nozzle outlet and including a downward turn of about 90 degrees or less, the nozzle cavity having a length to diameter ratio of about 3 to 10, and the nozzle cavity having a convergence angle of at least about 10°;

wherein a ratio of a nozzle inlet area to a nozzle outlet area is at least about 20.

19. The nozzle of claim 18, further comprising a nozzle injection angle of about 0° to 30°.

20. The nozzle of claim 18, wherein the nozzle cavity has a length to diameter ratio of about 3 to 5.

* * * * *